US006877817B1

(12) United States Patent
Brown

(10) Patent No.: US 6,877,817 B1
(45) Date of Patent: Apr. 12, 2005

(54) STOOL WITH LEG SUPPORTS

(76) Inventor: Nancy L. Brown, 256 Blanchard Rd., Cumberland, ME (US) 04021

( * ) Notice: Subject to any disclaimer, the term of this patent is extended or adjusted under 35 U.S.C. 154(b) by 0 days.

(21) Appl. No.: 10/676,003

(22) Filed: Oct. 2, 2003

(51) Int. Cl.[7] ..... A47C 25/00
(52) U.S. Cl. ..... 297/461
(58) Field of Search ..... 297/463.2, 181, 297/461, 451.2, 462; D8/334, 351, 358, 388, 404, 500, 501, 502

(56) References Cited

U.S. PATENT DOCUMENTS

| | | | | |
|---|---|---|---|---|
| D114,681 S | * | 5/1939 | Kellog | D6/351 |
| D244,644 S | | 6/1977 | Null | |
| D244,973 S | | 7/1977 | Heumann | |
| D245,379 S | | 8/1977 | Beal, Jr. | |
| D248,430 S | | 7/1978 | Bussey et al. | |
| D254,279 S | | 2/1980 | Phillips | |
| 4,212,090 A | | 7/1980 | Ehrlich | |
| 4,224,693 A | * | 9/1980 | Wehrmann et al. | 2/241 |
| D259,903 S | | 7/1981 | Sidewater | |
| 4,332,405 A | * | 6/1982 | Lawrason, Sr. | 289/16.5 |
| D272,489 S | | 2/1984 | Satterfield | |
| 4,462,636 A | | 7/1984 | Markson | |
| D284,430 S | * | 7/1986 | Satterfield | D6/450 |
| 4,700,914 A | * | 10/1987 | Cheetham | 248/155.1 |
| D319,352 S | | 8/1991 | Desnoyers | |
| D350,856 S | | 9/1994 | Greene | |
| D366,968 S | * | 2/1996 | Elsbury | D6/351 |
| D371,682 S | * | 7/1996 | Collings | D6/351 |
| D382,124 S | | 8/1997 | Chandler | |
| D425,729 S | * | 5/2000 | Manzak | D6/452 |
| 6,126,240 A | * | 10/2000 | Tse | 297/461 |
| D461,965 S | | 8/2002 | Stokes | |

FOREIGN PATENT DOCUMENTS

| | | |
|---|---|---|
| JP | 2002300980 | * 10/2002 |

* cited by examiner

*Primary Examiner*—Milton Nelson, Jr.
(74) *Attorney, Agent, or Firm*—Richard C. Litman

(57) ABSTRACT

The stool with leg supports which may be used as a footrest, a table, or a chair. The stool has a flat wooden platform, a cushion that is disposed upon the platform and either three or four legs which depend from the platform. Each leg includes is formed by a post and padding which is wrapped around the post. Each leg is also provided with socks, nylon hosiery, pant legs, or other suitable clothing or accessory commonly worn over the legs and feet. A second end of each leg is affixed to a shoe to provide a broader base for the stool, and thereby increase the stool's stability.

16 Claims, 6 Drawing Sheets

STOOL WITH LEG SUPPORTS

BACKGROUND OF THE INVENTION

1. Field of the Invention

The present invention relates to a stool, and more particularly to a stool with leg supports which is suitable for use as a footrest, a seat, or a table.

2. Description of the Related Art

While conventional footstools provide adequate support for feet, they are not stable enough to be used for other purposes. For example, a conventional footstool cannot easily be used as a seat or a table because it is generally provided with only two legs and each leg of a conventional footstool is simply a vertical support structure which lacks horizontal reinforcement. Consequently, conventional footstools are likely to tip over on one side upon even the slightest amount of pressure.

U.S. Des. Pat. No. 248,430, issued Jul. 11, 1978 to Bussey et al., discloses an ornamental design for a footstool. The footstool includes a platform and two legs which depend from the platform. The legs are configured to resemble human legs with feet protruding from one end.

U.S. Des. Pat. No. 259,903, issued Jul. 21, 1981 to Rosalyn G. Sidewater, discloses an ornamental design for a stool. The stool has only two legs. Each of the legs are provided with pant legs and shoes.

U.S. Des. Pat. No. 272,489, issued Feb. 7, 1984 to R. E. Satterfield, discloses an ornamental design for a footstool. The footstool includes a flat platform with two legs depending therefrom. Each leg has a shoe-like structure protruding from one end.

U.S. Des. Pat. No. 366,968, issued Feb. 13, 1996 to R. F. Elsbury discloses an ornamental design for a footstool. The footstool includes a flat platform with two legs depending therefrom. Each leg is covered with pant legs and has a boot-like structure protruding from one end.

Other footstools and ottomans are shown in U.S. Des. Pat. No. 244,644, issued Jun. 14, 1977 to P. L. Null (ornamental design for a convertible bench); U.S. Des. Pat. No. 244,973, issued Jul. 12, 1977 to J. H. Heumann (ornamental design for an ottoman); U.S. Des. Pat. No. 254,279, issued Feb. 26, 1980 to P. L. Phillips (ornamental design for an ottoman); U.S. Des. Pat. No. 319,352, issued Aug. 27, 1991 to C. Desnoyers (ornamental design for an ottoman); U.S. Des. Pat. No. 245,379, issued Aug. 16, 1977 to L. Beal, Jr. (ornamental design for an ottoman); U.S. Des. Pat. No. 350,856, issued Sep. 27, 1994 to M. W. Greene (ornamental design for an ottoman); U.S. Des. Pat. No. 382,124, issued Aug. 12, 1997 to D. P. Chandler (ornamental design for an ottoman); U.S. Des. Pat. No. 461,965 S, issued Aug. 27, 2002 to M. Stokes (ornamental design for an ottoman); U.S. Pat. No. 4,212,090, issued Jul. 15, 1980 to L. Ehrlich (ottoman convertible); U.S. Pat. No. 4,462,636, issued Jul. 31, 1984 to M. Markson (footstool); and Great Britain Pat. No. 2,086,720, published May 19, 1982 (leg rest for use with a chair).

None of the above inventions and patents, taken either singly or in combination, is seen to describe the instant invention as claimed. Thus a stool with leg supports according to the present invention solving the aforementioned problems is desired.

SUMMARY OF THE INVENTION

The present invention relates to a stool with leg supports. The stool of the present invention may be used as a footrest, a table, or a seat. The stool of the present invention includes a horizontal top and at least three legs which depend from the platform. Each leg includes a post and padding which is wrapped around the post. Each leg is also provided with socks, nylon hosiery, pant legs, or other suitable clothing or accessory commonly worn over the legs and feet. A bottom end of each leg is affixed to a shoe to provide a broader base for the stool, and thereby increase the stool's stability.

It is an object of the invention to provide a stool with leg supports that can be used as a footstool.

It is another object of the invention to provide a stool with leg supports that has padded legs to protect against stubbing one's toes against a rigid leg.

It is yet another object of the invention to provide a stool with leg supports that is sufficiently stable for use as a table or seat.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The present invention relates to a stool with leg supports which may be used as a seat, a table, or a footrest.

Figure 1:
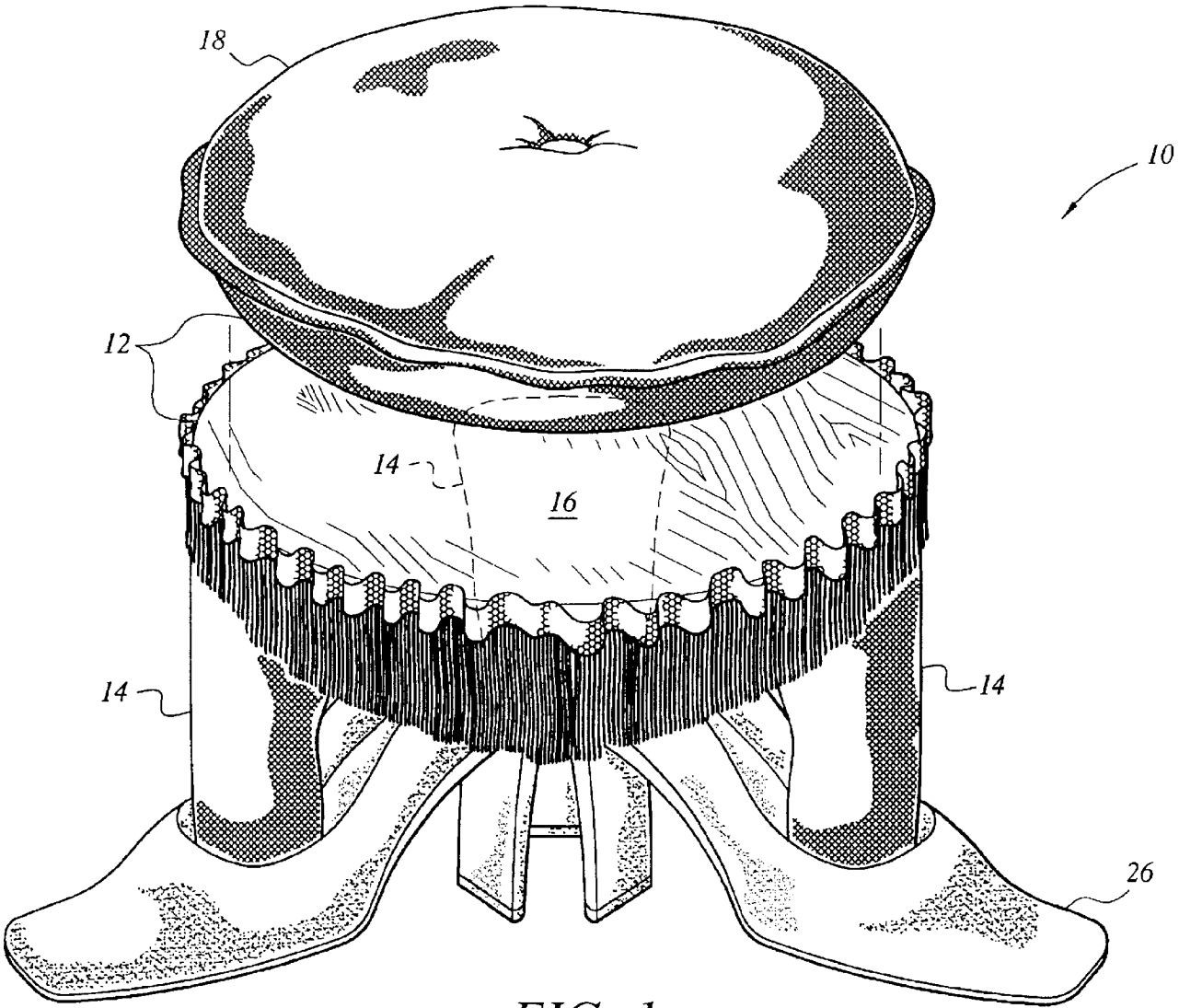
FIG. 1 is a partially exploded perspective view of a stool with leg supports according to a first embodiment of the present invention.

FIG. 1 depicts a first embodiment of a stool with leg supports, generally designated as 10 in the drawings. The stool 10 includes a horizontal top 12 and three legs 14 which depend from the top 12. Each leg 14 may be configured to resemble a human leg as is shown. The horizontal top 12 includes a circular support platform 16 made of plywood or other suitable material and a cushion 18 which is attached to a top surface of the platform 16. Any suitable upholstery and trimming may be used to cover and decorate the top 12. A button may be affixed to the center of the cushion 18 to create the appearance of a tuffet.

Figure 2:
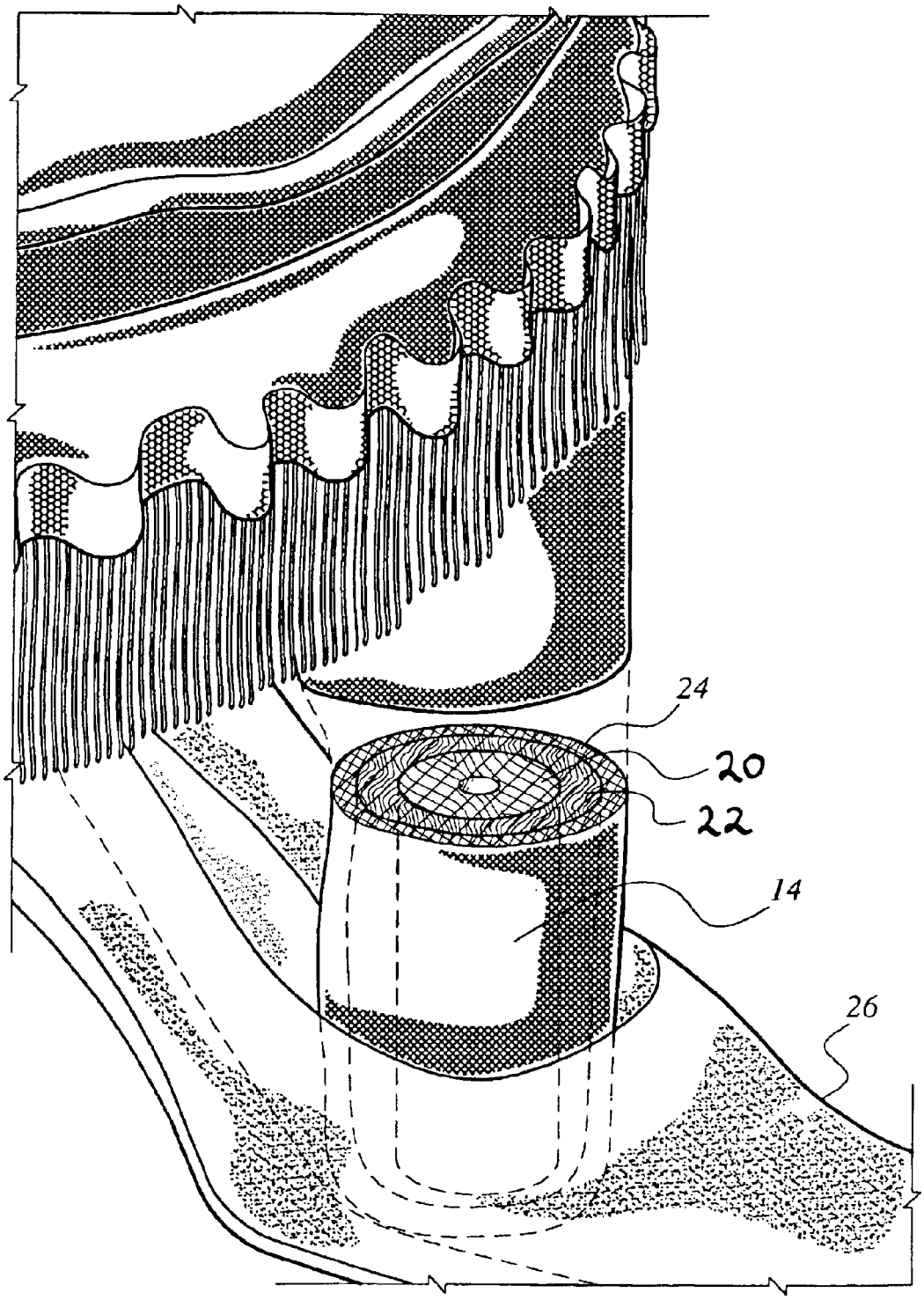
FIG. 2 is a fragmented, perspective view of a stool with leg supports according to the first embodiment of the present invention with a leg broken away and in section to show details of construction.
Figure 2A:
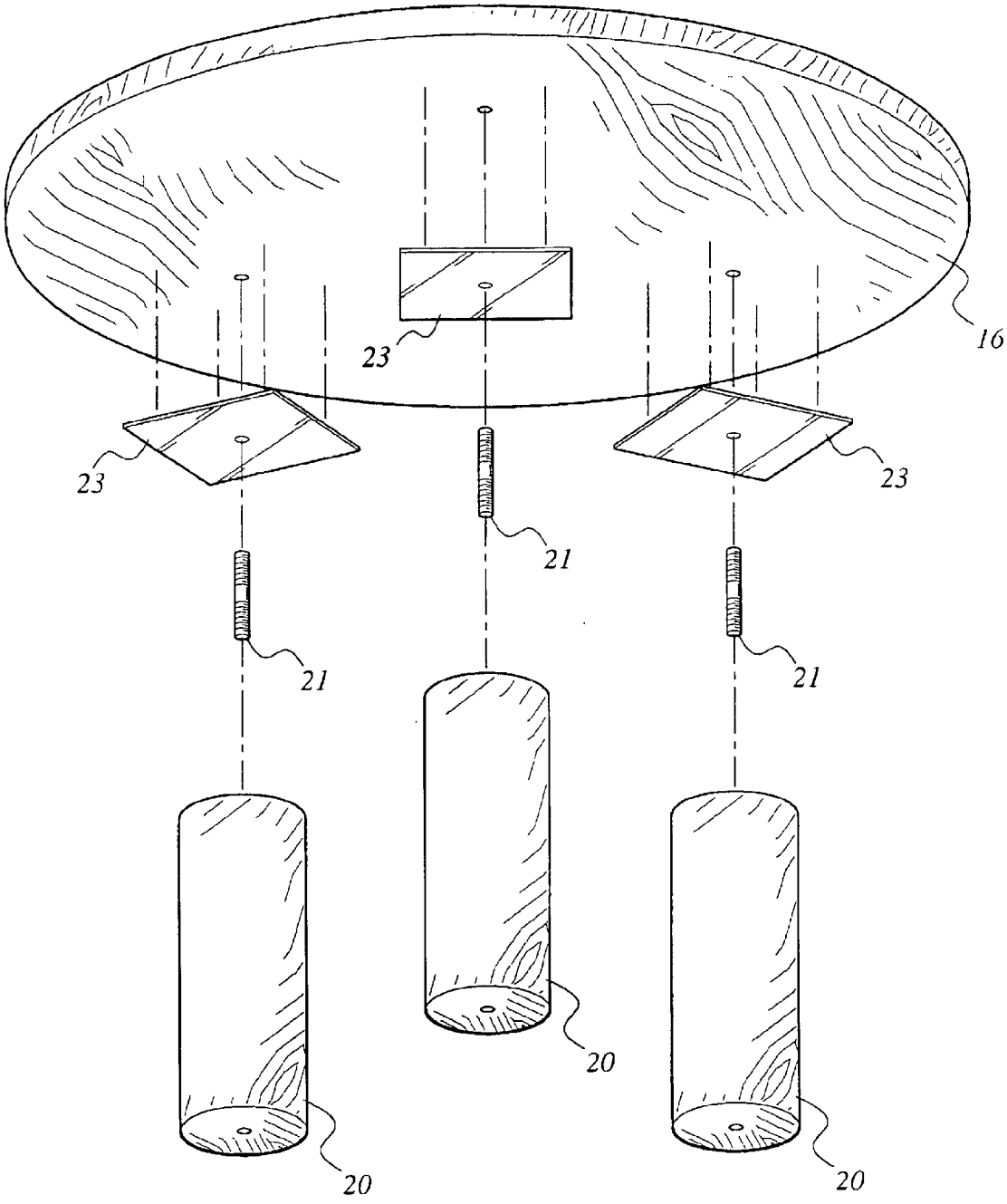
FIG. 2*a* is an exploded, perspective view of a stool with leg supports according to the present invention, showing the bolts and brackets used to join the posts with the platform.

As is shown in FIG. 2, each leg 14 is formed from a rigid post 20 and padding 22 wrapped around the post 20. A top end of the post 20 is affixed to the platform 16 and a bottom end is affixed to a shoe 26 in any suitable manner. Each post 20 can be made from wood, plastic, metal, or any other suitable material, and may be either solid or tubular. As is shown in the drawings, the post 20 is preferably a cylindrical structure. As shown in FIG. 2*a*, it is also preferred that the post 20 be affixed to the platform 16 with a hanger bolt 21. To promote greater stability, metal brackets 23 may be affixed to the platform 16 for receiving the bolts 21. Preferably, one end of the bolt 21 is machine threaded to the platform 16 and an opposing end of the bolt 21 is threaded to the post 20. The padding 22 is preferably polyester battening.

Each leg 14 may be further provided with any kind of suitable leg covering 24, including for example, socks, nylon hosiery, and pant legs. As can be seen, the leg covering 24 extends over the padding 22. The sole of each shoe 26 is preferably bolted to the leg 14. The shoes 26, once affixed to each leg 14, provide a broader base for supporting the stool 10 and help prevent the stool 10 from tipping over.

Figure 3:
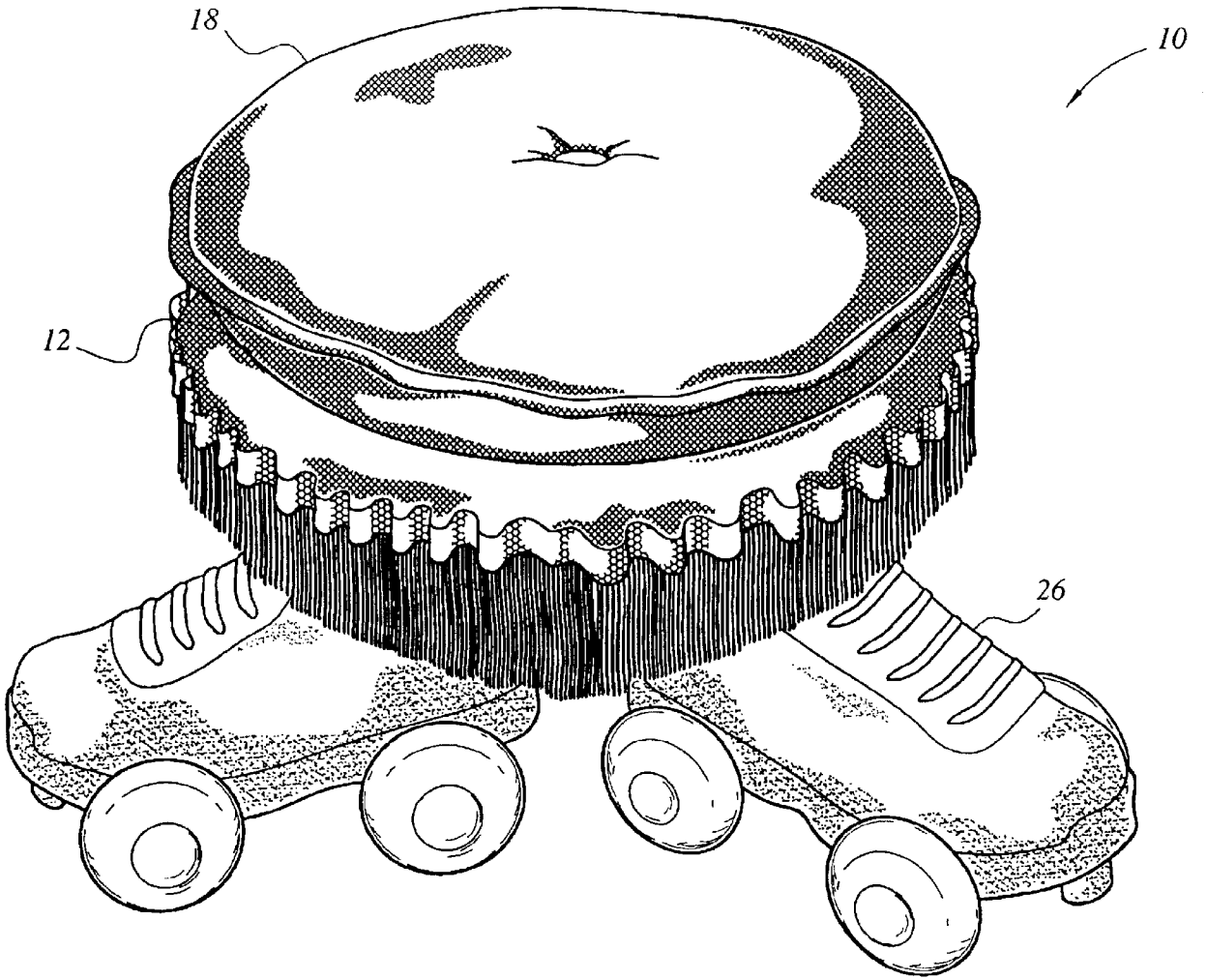
FIG. 3 is a perspective view of a stool with leg supports according to the first embodiment of the present invention.
Figure 4:
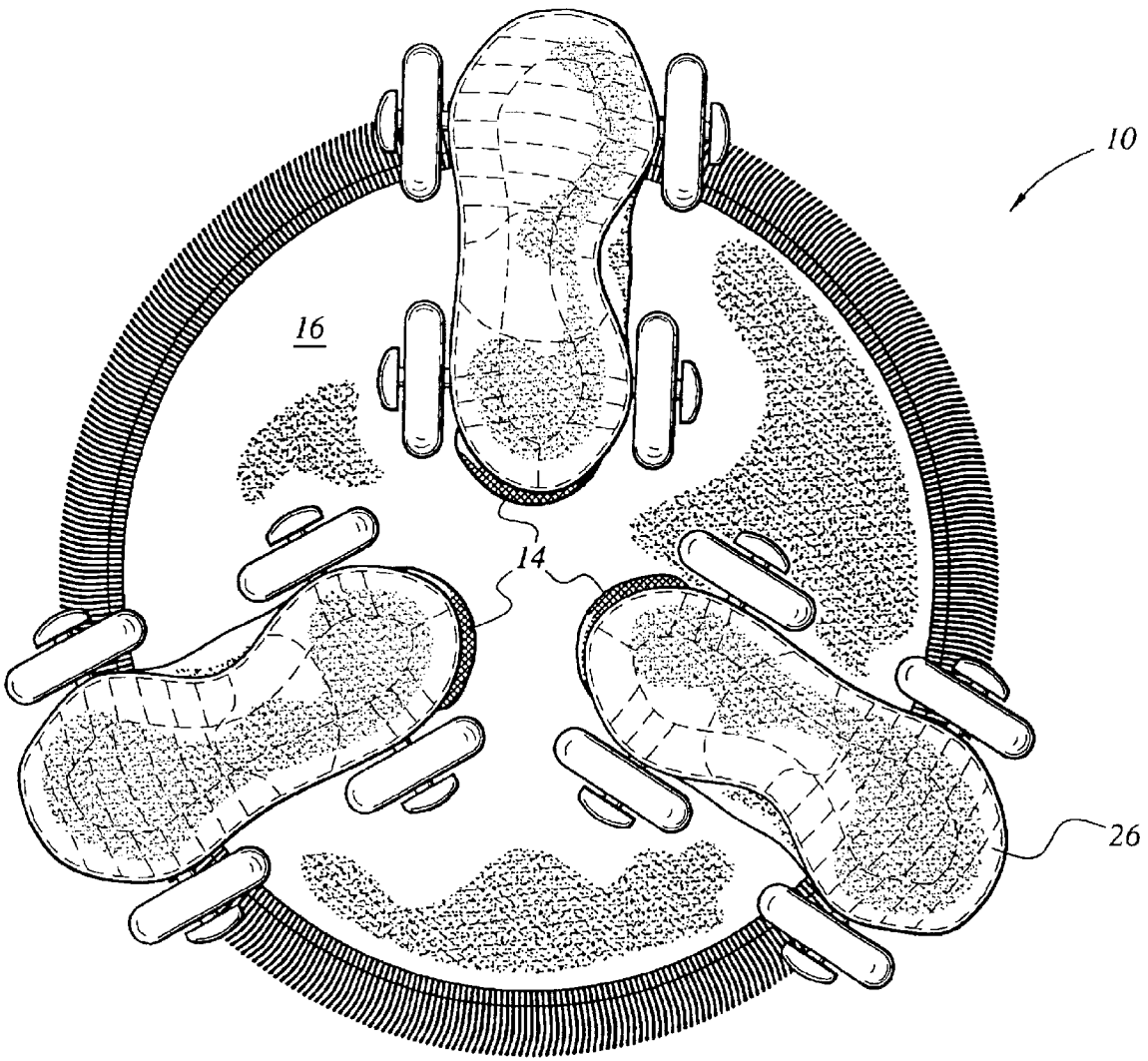
FIG. 4 is a bottom view of a stool with leg supports according to the first embodiment of the present invention.

Any type of shoe 26 may be employed in the present invention, including, for example, pumps, soccer cleats, tennis shoes, boots, ballet shoes, and roller skates. FIG. 3 depicts the stool 10 with roller skates. As can be seen, the roller skates 26 provide a broader base for the stool 10 to help prevent the stool 10 from tipping over. The roller skates 26 are oriented in different directions to prevent the stool 10 from rolling on the roller skate wheels, as is depicted in FIG. 4, i.e., the skates extend radially from the center of the stool 10 and are spaced apart by 120°.

Figure 5:
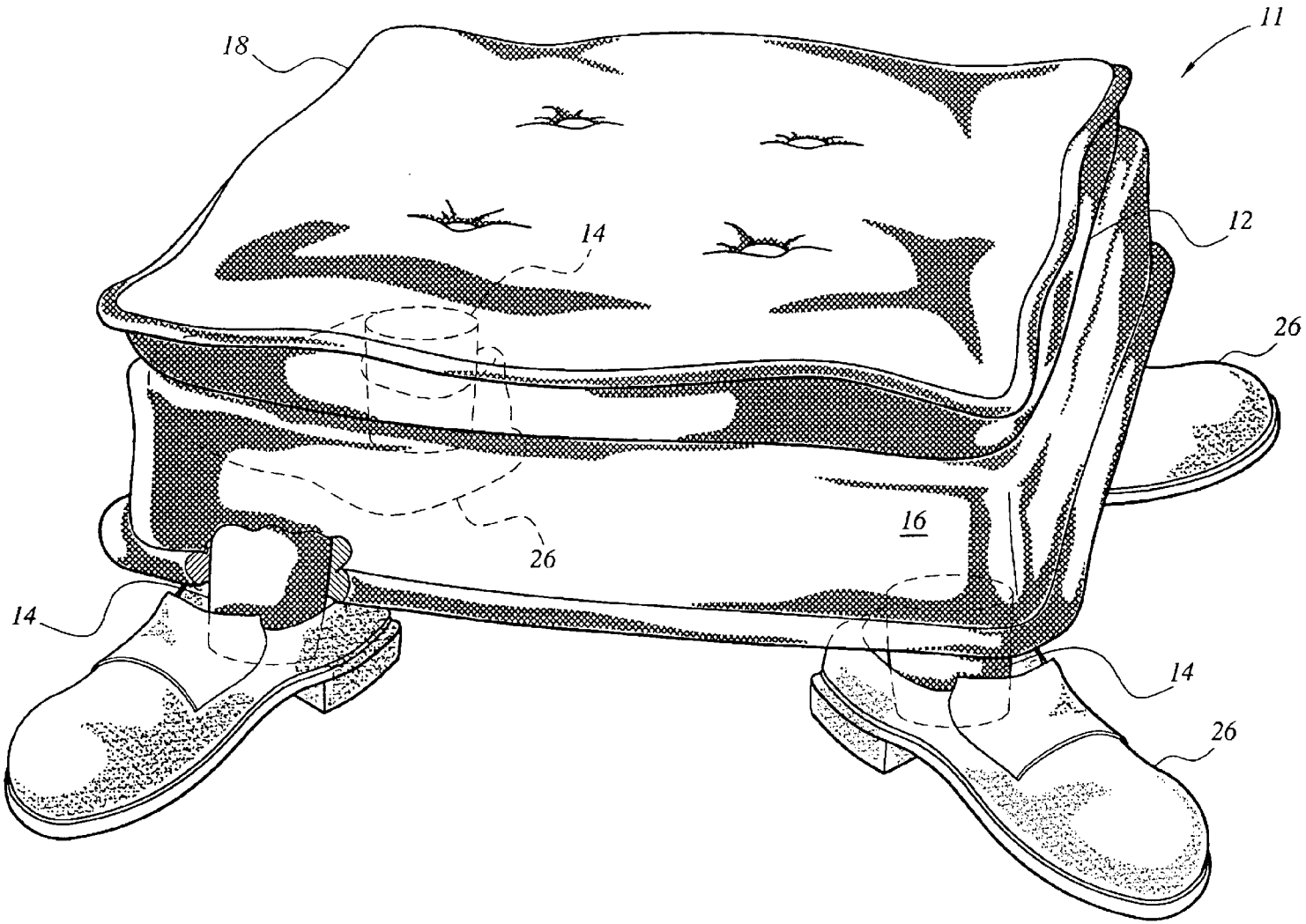
FIG. 5 is a perspective view of a stool with leg supports according to a second embodiment of the present invention.

An alternative embodiment of the stool, generally designated as 11, is depicted in FIG. 5. The stool 11 is identical to the stool 10 except that the top 12 is rectangular instead of circular, and instead of having three legs 14, four legs 14 depend from the platform 16, one from each corner.

It is to be understood that the present invention is not limited to the embodiments described above, but encompasses any and all embodiments within the scope of the following claims.

I claim:

1. A stool with leg supports, comprising:

a top, said top including a circular platform having a top surface and a bottom surface;

a cushion affixed to the top surface of said platform;

three metal brackets affixed to the bottom surface of said platform, three legs depending from said platform in alignment with said three metal brackets, each of said legs including a rigid post and padding material disposed around the post and having a top end and a bottom end, the top end of each said post being affixed to the bottom surface of the platform by a hanger bolt connected to each of the metal brackets; and a shoe attached to the bottom end of each of the legs;

wherein each said shoe is equally spaced apart from each other by about 120 degrees.

2. The stool of claim 1, wherein each leg further includes a sock disposed over said padding material.

3. The stool of claim 1, wherein each leg further includes nylon hosiery disposed over said padding material.

4. The stool of claim 1, wherein a pant leg is disposed over said padding material.

5. The stool of claim 1, wherein said platform is a circular piece of wood.

6. The stool of claim 1, wherein said shoe is a roller skate.

7. The stool of claim 1, wherein each said shoe extends radially from a center of the platform.

8. The stool of claim 1, wherein said post is made from wood.

9. The stool of claim 1, wherein said post is tubular.

10. The stool of claim 1, wherein said post is made from plastic.

11. The stool of claim 1, wherein said post is made from metal.

12. The stool of claim 1, wherein said shoe is a pump.

13. The stool of claim 1, wherein said shoe is a tennis shoe.

14. The stool of claim 1, wherein said shoe is a boot.

15. The stool of claim 1, wherein said shoe is a ballet shoe.

16. A stool with leg supports, comprising:

a top, said top including a rectangular platform and having a top surface and a bottom surface;

a cushion affixed to the top surface of said platform;

four metal brackets affixed to the bottom surface of said platform;

four legs depending from said platform in alignment with the metal brackets, each of said legs including a rigid post and padding material disposed around the post and having a top end and a bottom end, the top end of each said post being affixed to the bottom surface of the platform by a hanger bolt connected to each of the metal brackets; and a shoe attached to the bottom end of each of the legs.

* * * * *